US007812708B2

(12) United States Patent
Müller et al.

(10) Patent No.: US 7,812,708 B2
(45) Date of Patent: Oct. 12, 2010

(54) MANIPULATION PROTECTION FOR A FIRE DETECTOR

(75) Inventors: Kurt Müller, Männedorf (CH); Peter Steiner, Jona (CH)

(73) Assignee: Siemens AG, Munich (DE)

( * ) Notice: Subject to any disclaimer, the term of this patent is extended or adjusted under 35 U.S.C. 154(b) by 338 days.

(21) Appl. No.: 12/089,787

(22) PCT Filed: Nov. 2, 2006

(86) PCT No.: PCT/EP2006/068035

§ 371 (c)(1),
(2), (4) Date: Apr. 10, 2008

(87) PCT Pub. No.: WO2007/051819

PCT Pub. Date: May 10, 2007

(65) Prior Publication Data

US 2008/0252468 A1 Oct. 16, 2008

(30) Foreign Application Priority Data

Nov. 4, 2005 (EP) ..... 05110342

(51) Int. Cl.
*G08B 17/00* (2006.01)

(52) U.S. Cl. ..... 340/286.05

(58) Field of Classification Search ..... 340/286.05, 340/578, 628, 630, 555, 577; 250/574
See application file for complete search history.

(56) References Cited

U.S. PATENT DOCUMENTS 5,568,130 A * 10/1996 Dahl ..... 340/630
5,576,697 A * 11/1996 Nagashima et al. ..... 340/630
6,011,478 A * 1/2000 Suzuki et al. ..... 340/630
6,218,950 B1 * 4/2001 Politze et al. ..... 340/630

* cited by examiner

*Primary Examiner*—Phung Nguyen
(74) *Attorney, Agent, or Firm*—Laurence A Greenberg; Warner H Stemer; Ralph E Locher

(57) ABSTRACT

A method for differentiating between a fire and the manipulation of a fire detector. The fire detector has at least two sensor units, each of which contains a light source and a light collector. A cover plate is formed with at least two light exit and entry windows. The device is used to monitor at least one fire parameter in the area surrounding the fire detector according to a scattered light method. The respective light entry and exit windows on the cover plate are connected to an optical fiber element in such a way that light from the light source of one sensor unit is guided to and captured by the light collector of the other sensor unit.

13 Claims, 1 Drawing Sheet

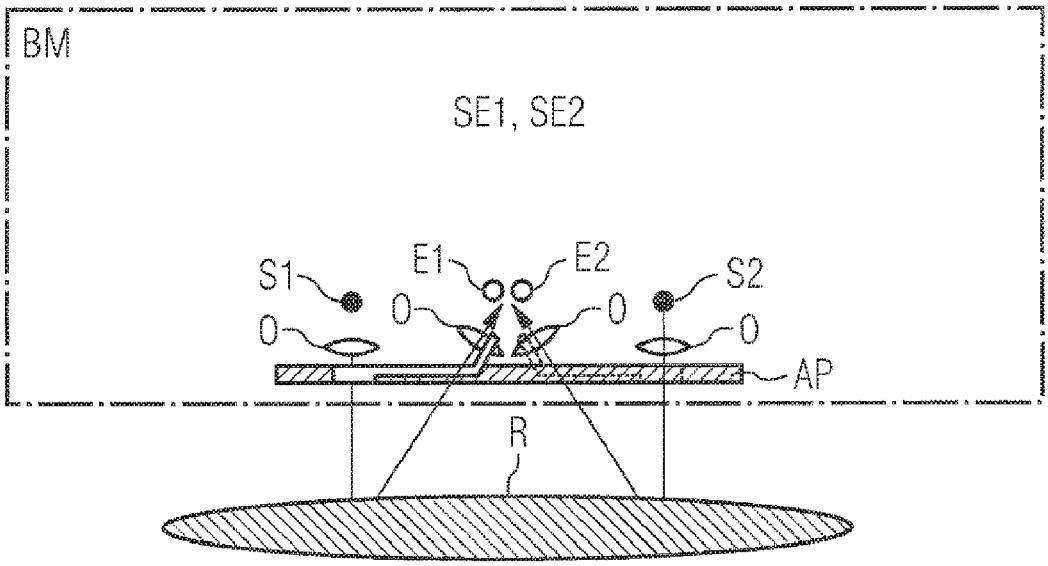
BM
SE1, SE2
S1
E1
E2
S2
0
0
0
0
AP
R
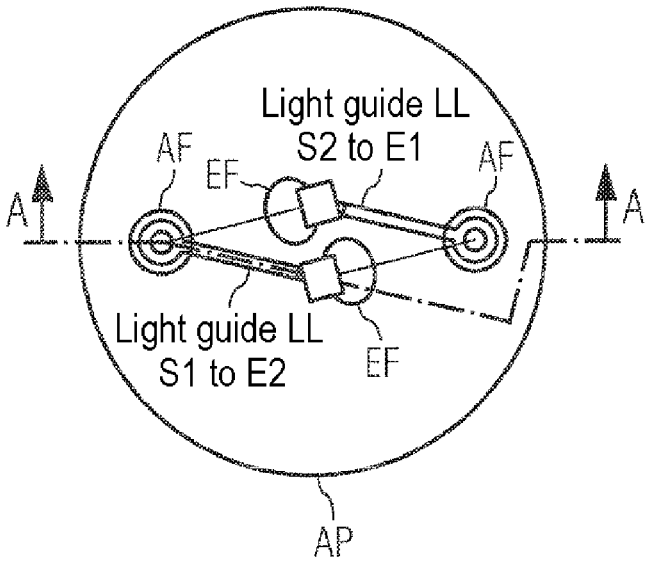
Light guide LL
S2 to E1
AF
EF
AF
A
A
Light guide LL
S1 to E2
EF
AP

MANIPULATION PROTECTION FOR A FIRE DETECTOR

CROSS-REFERENCE TO RELATED APPLICATIONS

This application is a §371 national stage of international application PCT/EP2006/06835, filed Nov. 2, 2006; the application claims the priority of European patent application EP 05110342.1, filed Nov. 4, 2005; the prior application is herewith incorporated by reference in its entirety.

BACKGROUND OF THE INVENTION

Field of the Invention

The invention relates to a method for distinguishing a fire from a manipulation in a fire detector which comprises at least two sensor units, which each contain one light source and one light receiver, and a cover plate with in each case at least two light exit and entrance windows, which is used to monitor at least one fire parameter according to the scattered light method in the region surrounding the fire detector.

Every optical fire detector which is fastened to the ceiling of a spatially delimited space and has no closed measurement chamber, that is to say receives scattered light from the region surrounding the fire detector, can be blocked or manipulated by large-area objects, such as a hand, cleaning instruments etc., such that for example either the fire detector can no longer monitor a fire parameter or a false alarm is triggered on account of false information, such as water vapor, mist, etc., which is interpreted as a fire parameter by the fire detector. Such manipulations must be clearly distinguishable from smoke or a fire, so that a reliable monitoring of a spatially delimited space is ensured. Fire detectors, which monitor a fire parameter according to the scattered light method in the region surrounding the fire detector, generally comprise at least two sensor units which each comprise a transmitting and a receiving unit and can be integrated in the ceiling or can be fastened to the ceiling. Usually a cover plate with entrance and exit windows for the light is used to protect the sensor units. If the manipulation takes place near an exit window, the fire detector can determine this inter alia by way of the scattered light. However, if the manipulation takes place on the exit window or there is in fact vapor, additional measures need to be taken.

BRIEF SUMMARY OF THE INVENTION

It is an object of the present invention to propose an option, which is as simple and efficient as possible, for detecting a manipulation of a fire detector which monitors a fire parameter according to the scattered light method in the region surrounding the fire detector.

The object is achieved according to the invention in each case by the subject matters of the independent patent claims. Developments of the invention are stated in the subclaims.

The core of the invention can be seen in the fact that in order to distinguish a fire from a manipulation of a fire detector with at last two sensor units, which each contain one light source and one light receiver, and a cover plate with in each case at least two light exit and entrance windows, said fire detector monitors at least one fire parameter according to the scattered light method in the region surrounding the fire detector. According to the invention, in the cover plate, the respective light exit and light entrance windows are each connected to a light-guiding element such that the light, which emanates from the light source of the sensor unit and is reflected at the external surface of the cover, is received using the light receiver of the further sensor unit. Examples of the light-guiding element used are a tunnel, a trench or a recess, and/or an optical-fiber connection in the cover plate. Here, the light-guiding element can be lined with a light-reflecting material, for example a specular metal coating to increase efficiency. This is necessary especially if strongly focused laser light is used for the scattered light method because the light scattered back from the external surface of the window, that is to say the external boundary surface of the light exit window, must be guided reliably into the light guide. The cover plate can be made of plastic, metal, wood, glass etc. Strongly focused laser light or another suitable light can preferably be used as the light, which is emitted by the light source. The smoke detector with the at least two sensor units is fastened to the ceiling of the spatially delimited space. It can be integrated in the ceiling or mounted on the ceiling.

A major advantage of the invention can be seen in the fact that the fire detector can distinguish in a simple manner whether there has been a fire or a manipulation. In particular, triggering of a false alarm in the fire detector due to a manipulation for example because the light exit window is covered or because there is vapor on the light exit window can be avoided in a very simple manner.

The invention will be explained in more detail with reference to an exemplary embodiment illustrated in a FIGURE. Here, the following FIGURE shows an arrangement using light-guiding elements which are integrated in the fire detector cover or cover plate.

BRIEF DESCRIPTION OF THE DRAWING

The FIGURE is a schematic diagram illustrating a fire detector that monitors a fire parameter according to the scattered light method in a sectional side view and in a plan view.

DESCRIPTION OF THE INVENTION

FIG. 1 shows a fire detector which monitors a fire parameter according to the scattered light method in the region R surrounding the fire detector BM. The fire detector BM has two sensor units SE1, SE2 with in each case one light source or light transmitting unit S1, S2 and one light receiving unit E1, E2. Optical elements O, such as optical lenses, for example, are used for the purposes of light beam focusing. Strongly focused laser light is ideally used to monitor the fire parameter in accordance with the scattered light method, but any type of light is feasible in principle. A cover plate AP is used in the fire detector BM for covering purposes, in particular for the protection of the sensor units SE1, SE2. Said cover plate can have any desired shape, such as a round shape, for example. The cover plate AP can be made of wood, metal, plastic, glass etc. and has light entrance EF and exit windows AF. Light-guiding elements LL, so-called light guides, are present in the cover plate AP, such that the light source S2 is connected to the light receiver E1 and the light source S1 is connected to the light receiver E2. Some of the light reflected at the external surface of the exit window AF is coupled into the respective light guides LL. During normal operation, only little light is reflected back at known intensity and guided to the receiver E1, E2 of the respective sensor unit SE2, SE1 via the light guide LL. The associated signal level, i.e. the intensity of the received light can be used as a monitoring signal for the correct function of the respective transmitter S1, S2. If, however, the exit window AF is impermissibly exposed to manipulation or soiling, this additional light is reflected diffusely and coupled into the light guide LL. Due to the signal increase or the increase in the intensity of the light received at the light receiver E1, E2, this type of situation (manipulation) can then be distinguished from normal operation. Thus a manipulation of the fire detector can be assumed if a threshold value which was previously defined, for example, for the intensity of the light received at the light receiver E1, E2 is exceeded. Since light is guided from an exit window AF onto the light receiver of the other channel, it is now possible during the monitoring of a fire parameter to differentiate whether there really is a fire or whether a manipulation has occurred. Examples of manipulation are the covering of a light exit window AF, vapor, mist etc.

The invention claimed is:

1. In a fire detector configured to monitor at least one fire parameter according to the scattered light method in a vicinity of the fire detector, with two sensor units each containing a light source and a light receiver, and with a cover plate having at least two light exit windows and light entrance windows, a method of distinguishing a fire from a manipulation of the fire detector, which comprises:

providing a light-guiding element at the cover plate for optically connecting a light exit window associated with the first sensor unit to a light entrance window of the second sensor unit and a light exit window associated with the second sensor unit to a light entrance window of the first sensor unit; and receiving light originating from the light source of the first sensor unit, and reflected at an external interface of the light exit window, with the light receiver of the second sensor unit.

2. The method according to claim 1, which comprises also conducting light originating from the light source of the second sensor unit, after reflection at the respective light exit window, to the light receiver of the first sensor unit.

3. The method according to claim 1, which comprises conducting the light by way of a light-guiding element formed as a tunnel, a trench and/or an optical-fiber connection in the cover plate.

4. The method according to claim 1, which comprises providing a light-guiding element coated with light-reflecting material.

5. The method according to claim 1, which comprises forming the cover plate of plastics, metal, and/or wood.

6. The method according to claim 1, which comprises operating the device with strongly focused laser light.

7. The method according to claim 1, which comprises fastening the fire detector to a ceiling of a spatially delimited space.

8. The method according to claim 1, which comprises measuring an intensity of the light received at the light receiver.

9. The method according to claim 8, which comprises assuming a manipulation of the fire detector if a threshold value is exceeded.

10. A fire detector, comprising:

first and second sensor units each containing a light source for transmitting light and a light receiver for receiving light;

a cover plate formed with at least two light exit windows and light entrance windows;

a light-guiding element disposed to conduct light originating from said light source of said first sensor unit towards said light receiver of said second sensor unit and to conduct light originating from said light source of said second sensor unit towards said light receiver of said first sensor unit.

11. The fire detector according to claim 10, wherein said light-guiding element is disposed to conduct light reflected at an external interface of said light exit window of a given one of said first and second sensor units to the light receiver of the respectively other said sensor unit.

12. The fire detector according to claim 10, which comprises means for distinguishing a fire from a manipulation of the fire detector.

13. The fire detector according to claim 10, configured to monitor at least one fire parameter according to the scattered light method in a vicinity of the fire detector.

* * * * *